US008562181B2

(12) United States Patent
Dong et al.

(10) Patent No.: US 8,562,181 B2
(45) Date of Patent: Oct. 22, 2013

(54) LIGHT EMITTING DIODE BULB

(75) Inventors: Chao-Hsien Dong, New Taipei (TW); Jen-Hui Wang, New Taipei (TW)

(73) Assignee: Everlight Electronics Co., Ltd. (TW)

( * ) Notice: Subject to any disclaimer, the term of this patent is extended or adjusted under 35 U.S.C. 154(b) by 0 days.

(21) Appl. No.: 13/490,667

(22) Filed: Jun. 7, 2012

(65) Prior Publication Data

US 2012/0314422 A1 Dec. 13, 2012

(30) Foreign Application Priority Data

Jun. 10, 2011 (TW) ..... 100120417 A

(51) Int. Cl.
*F21V 29/00* (2006.01)

(52) U.S. Cl.
USPC ..... 362/294; 362/249.02; 362/373

(58) Field of Classification Search
USPC ..... 362/294, 373, 249.02; 313/46
See application file for complete search history.

(56) References Cited

U.S. PATENT DOCUMENTS

| | | | | |
|---|---|---|---|---|
| 7,637,643 | B2 * | 12/2009 | Maxik | 362/373 |
| 8,274,241 | B2 * | 9/2012 | Guest et al. | 315/294 |
| 8,324,835 | B2 * | 12/2012 | Shum et al. | 315/291 |
| 8,382,329 | B2 * | 2/2013 | Lutz et al. | 362/285 |
| 2010/0096992 | A1 | 4/2010 | Yamamoto et al. | |
| 2011/0089830 | A1 * | 4/2011 | Pickard et al. | 315/32 |
| 2011/0089831 | A1 | 4/2011 | Takahasi et al. | |

FOREIGN PATENT DOCUMENTS

| | | |
|---|---|---|
| CN | 201351822 | 11/2009 |
| EP | 2224161 | 9/2010 |
| JP | W02011039998 | 4/2011 |
| JP | W02011152115 | 12/2011 |
| TW | M372427 | 1/2010 |
| TW | M388732 | 9/2010 |
| TW | M391184 | 10/2010 |

OTHER PUBLICATIONS

Straus; Becker Kurig, European Search Report for Application No. 12171310.1-1757/2532942, Jul. 11, 2013, pp. 1 - 9, European Patent Office.
Straus; Becker Kurig, European Search Report for Application No. 12171310.1-1757/2532942, Jul. 11, 2013, pp. 1-9, European Patent Office.

* cited by examiner

*Primary Examiner* — Peggy A. Neils
(74) *Attorney, Agent, or Firm* — Han IP Corporation

(57) ABSTRACT

A light emitting diode bulb comprises a heat sink, an insulator cover, a light emitting device package, a plurality of conductive terminals, a driving circuit, a holder, a metal screw thread, and an electrode. The light emitting device package, disposed between the insulator cover and heat sink, is covered by the insulator cover which exposes a portion of the light emitting device package. The conductive terminals are connected with the insulator cover and extend outwardly to be connected with the light emitting device package. The driving circuit converts an AC signal into a DC signal and includes upper conductive rods and lower conductive rods. The conductive rods are connected with the conductive terminals. The holder is connected with the metal screw thread and heat sink. The metal screw thread is connected electrically to one of the lower conductive rods. The electrode is connected electrically to the other lower conductive rods.

20 Claims, 19 Drawing Sheets

LIGHT EMITTING DIODE BULB

CROSS-REFERENCE TO RELATED APPLICATION

This application claims the priority benefit of Taiwan Patent Application No. 100120417, filed on Jun. 10, 2011. The entirety of the above-identified patent application is hereby incorporated by reference and made a part of this specification.

BACKGROUND

1. Technical Field

The present invention relates to light bulbs and, more particularly, to a type of light emitting diode bulbs.

2. Description of Related Art

Along with the development of light emitting diodes (LEDs) the use of LEDs in light bulbs has become prevalent, and the low power consumption of LEDs meets the trend of environmental protection. LEDs generally have the light source output characteristics of point light source, high brightness and narrow light beam. The mechanical characteristics and reliability of LEDs are also different from those of traditional luminaires. Accordingly, pertinent testing standards with respect to solid-state lighting are being developed in various countries for a variety of applications, including roadside illumination, outdoor illumination, indoor illumination, etc.

In a typical LED bulb, an LED lamp board and a driving circuit are electrically coupled through a connector. However, under such configuration noise tends to increase as the length of the wire increases. Besides, the height of the connector on the LED lamp board may result in light being covered. Moreover, the LED lamp board and a heat sink are typically affixed together by one or more screws. This nevertheless increases the time of assembly. Additionally, as the driving circuit and a screw thread are usually electrically coupled together via wires, the time of assembly would be further increased.

SUMMARY

An objective of the present invention is to provide an LED bulb that can be assembled relatively more easily with shorter assembly time and lower cost of assembly.

According to one aspect, an LED bulb may comprise a heat sink, an insulator cover, a light emitting device package, a plurality of conductive terminals, a driving circuit, a holder, a screw head and an electrode. The heat sink may comprise a component receiving surface, a plurality of fastening through holes, and a plurality of positioning through holes. The fastening through holes and the positioning through holes may be disposed on the component receiving surface. The insulator cover may be disposed on the heat sink and may include an opening. The insulator cover may comprise a plurality of hooking parts and a plurality of terminal receptacles. The hooking parts and the terminal receptacles may protrude from a surface of the insulator cover. Each of at least some of the hooking parts may be configured to be engaged with a respective one of the fastening through holes and each of at least some of the terminal receptacles may be configured to pass through a respective one of the positioning through holes to be engaged with the respective positioning through hole such that the insulator cover is affixed to the heat sink. Each of at least some of the terminal receptacles respectively having a terminal receptacle through hole. The light emitting device package may be disposed on the component receiving surface of the heat sink and may include a plurality of driving electrodes. The light emitting device package may be disposed between the insulator cover and the heat sink. The light emitting device package may be affixed to the insulator cover with the opening of the insulator cover exposing a portion of the light emitting device package. The plurality of conductive terminals may be respectively disposed in the terminal receptacle through holes of the terminal receptacles. The conductive terminals may extend outwardly and in physical contact with the driving electrodes of the light emitting device package. The driving circuit may output a current signal to drive the light emitting device package. The driving circuit may comprise a plurality of upper conductive rods and a plurality of lower conductive rods. The upper conductive rods may be in physical contact with the conductive terminals. The holder may comprise a holding protrusion. The holder may be configured to be assembled to the heat sink via the holding protrusion. The screw thread may be coupled to the holder and may comprise a screw thread through hole. The screw thread may be electrically connected to a first one of the lower conductive rods. The electrode may be disposed in the screw thread through hole and electrically connected to a second one of the lower conductive rods.

In one embodiment, the LED bulb may further comprise a lens disposed on and coupled to the heat sink. The lens may at least partially or totally cover the light emitting device package and the insulator cover.

In one embodiment, the LED bulb may further comprise an insulation box disposed in the heat sink and containing the driving circuit therein. The insulation box may comprise a plurality of holes. The upper conductive rods and the lower conductive rods may traverse through the holes to be exposed outside of the insulation box.

In one embodiment, each of at least some of the conductive terminals respectively may comprise a terminal body and an extension electrode. The terminal body may comprise a terminal through hole and a plurality of hooking parts in the terminal through hole. The hooking parts may protrude in a direction away from the respective terminal through hole.

In one embodiment, the extension electrodes of the conductive terminals may extend outwardly and physically contact the driving electrodes of the light emitting device package.

In one embodiment, a sidewall of the terminal receptacle through hole of each of at least some of the terminal receptacles may respectively comprise a protrusion. The hooking parts of the terminal bodies and the protrusions of the terminal receptacles may be engaged together.

In one embodiment, each of at least some of the conductive terminals may comprise a terminal bending part in the respective terminal through hole that is electrically connected with at least some of the upper conductive rods.

In one embodiment, the light emitting device package may comprise a first surface and a second surface opposite to the first surface. The second surface may be connected to the component receiving surface and in physical contact with the heat sink. The driving electrodes may be disposed on the first surface.

In one embodiment, the heat sink may comprise a plurality of heat dissipation fins disposed around the heat sink.

According to another aspect, an LED bulb may comprise a heat sink, a light emitting device package, a driving circuit, a holder, a plurality of conductive terminals, a screw thread and an electrode. The heat sink may include a component receiving surface. The light emitting device package may be disposed on the component receiving surface and may comprise a plurality of driving electrodes. The driving circuit may output a current signal to drive the light emitting device package. The driving circuit may comprise a plurality of upper conductive rods and a plurality of lower conductive rods. The upper conductive rods may be electrically connected with the driving electrodes. The holder may comprise a holding protrusion and a plurality of terminal receptacles. Each of at least some of the terminal receptacles may comprise a respective terminal receptacle through hole. At least some of the lower conductive rods may be disposed in the terminal receptacle through holes. The plurality of conductive terminals may be respectively disposed in the terminal receptacle through holes of the terminal receptacles and in physical contact with the lower conductive rods. The screw thread may be coupled to the holder and may include a screw thread through hole. The electrode may be disposed in the screw thread through hole of the screw thread. The conductive terminals may extend outwardly and be in physical contact with the screw thread and the electrode such that each of the screw thread and the electrode is electrically connected with a respective one of the lower conductive rods.

In one embodiment, the LED bulb may further comprise a lens disposed on and coupled to the heat sink. The lens may at least partially or totally cover the light emitting device package.

In one embodiment, the LED bulb may further comprise an insulation box disposed in the heat sink and containing the driving circuit therein. The insulation box may comprise a plurality of holes, the upper conductive rods and the lower conductive rods traversing through the holes to be exposed outside of the insulation box.

In one embodiment, each of at least some of the conductive terminals respectively may comprise a terminal body and an extension electrode. The terminal body may comprise a terminal through hole and a plurality of hooking parts in the terminal through hole. The hooking parts may protrude in a direction away from the respective terminal through hole.

In one embodiment, the extension electrodes of the conductive terminals may extend outwardly and physically contact the screw thread and the electrode.

In one embodiment, a sidewall of the terminal receptacle through hole of each of at least some of the terminal receptacles may respectively comprise a protrusion. The hooking parts of the terminal bodies and the protrusions of the terminal receptacles may be engaged together.

In one embodiment, each of at least some of the conductive terminals may comprise a terminal bending part in the respective terminal through hole that is bent toward the respective terminal through hole and electrically connected with at least some of the lower conductive rods.

In one embodiment, the light emitting device package may comprise a first surface and a second surface opposite to the first surface. The second surface may be connected to the component receiving surface and in physical contact with the heat sink. The driving electrodes may be disposed on the first surface.

In one embodiment, the heat sink may comprise a plurality of heat dissipation fins disposed around the heat sink.

According to still another aspect, an LED bulb may comprise a heat sink, an insulator cover, a light emitting device package, a plurality of conductive terminals, a driving circuit, a holder, a plurality of second conductive terminals, a screw thread and an electrode. The heat sink may comprise a component receiving surface, a plurality of fastening through holes, and a plurality of positioning through holes. The fastening through holes and the positioning through holes may be disposed on the component receiving surface. The insulator cover may be disposed on the heat sink and may include an opening. The insulator cover may comprise a plurality of first hooking parts and a plurality of first terminal receptacles. The first hooking parts and the first terminal receptacles may protrude from a surface of the insulator cover. Each of at least some of the first hooking parts may be configured to be engaged with a respective one of the fastening through holes and each of at least some of the first terminal receptacles may be configured to pass through a respective one of the positioning through holes to be engaged with the respective positioning through hole such that the insulator cover is affixed to the heat sink. Each of at least some of the first terminal receptacles respectively may include a first terminal receptacle through hole. The light emitting device package may be disposed on the component receiving surface of the heat sink and may include a plurality of driving electrodes. The light emitting device package may be disposed between the insulator cover and the heat sink. The light emitting device package may be affixed to the insulator cover with the opening of the insulator cover exposing a portion of the light emitting device package. The plurality of first conductive terminals may be respectively disposed in the first terminal receptacle through holes of the first terminal receptacles. The first conductive terminals may extend outwardly and may be in physical contact with the driving electrodes of the light emitting device package. The driving circuit may comprise a plurality of upper conductive rods and a plurality of lower conductive rods. The upper conductive rods may be in physical contact with the first conductive terminals. The holder may comprise a holding protrusion and a plurality of second terminal receptacles. The holder may be configured to be assembled to the heat sink via the holding protrusion. Each of at least some of the second terminal receptacles may respectively comprise a second terminal receptacle through hole. The lower conductive rods may be disposed in the second terminal receptacle through holes. The plurality of second conductive terminals may be disposed in the second terminal receptacle through holes of the second terminal receptacles and in physical contact with the lower conductive rods. The screw thread may be coupled to the holder and may comprise a screw thread through hole. The screw thread may be electrically connected to a first one of the lower conductive rods. The electrode may be disposed in the screw thread through hole and electrically connected to a second one of the lower conductive rods. The second conductive terminals may extend outwardly and physically contact the screw thread and the electrode such that the screw thread and the electrode are electrically connected with the first one of the lower conductive rods and the second one of the lower conductive rods, respectively.

In one embodiment, the LED bulb may further comprise a lens disposed on and coupled to the heat sink. The lens may at least partially or totally cover the light emitting device package and the insulator cover.

In view of the above, in an LED bulb according to the present disclosure, the insulator cover and the heat sink are affixed together using a hooking method. Accordingly, the light emitting device package, which is disposed between the insulator cover and the heat sink, can be affixed thereto at the same time. That is, hooks may be directly used for assembling to the heat sink to reduce the cost and time associated with using screws to do the same. This advantageously enhances electrical insulation. Moreover, the first conductive terminals and the second conductive terminals may be respectively affixed to the insulator cover and the holder using the hooking method. This design reduces not only the noise associated with traditional connection by wires but also the time it takes to render electrical connection (e.g., wiring) as well as the light being covered by connection terminals. Furthermore, as the LED bulb may be assembled together using hooks, engagement or other fastening methods without the use of screws, potential hazards to a user when disassembling the LED bulb may be avoided.

Detailed description of various embodiments are provided below, with reference to the attached figures, to promote better understanding of the characteristics and benefits of the various embodiments of the present disclosure.

DETAILED DESCRIPTION OF DISCLOSED EMBODIMENTS

Figure 1A:
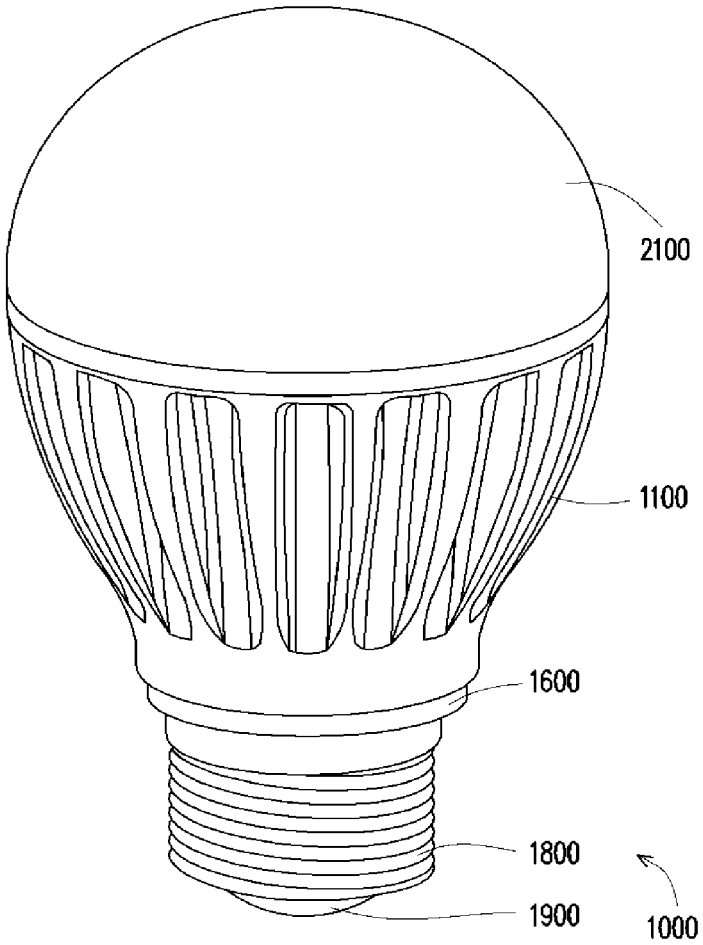
FIG. 1A is a perspective view of an LED bulb in accordance with an embodiment of the preset disclosure.
Figure 1B:
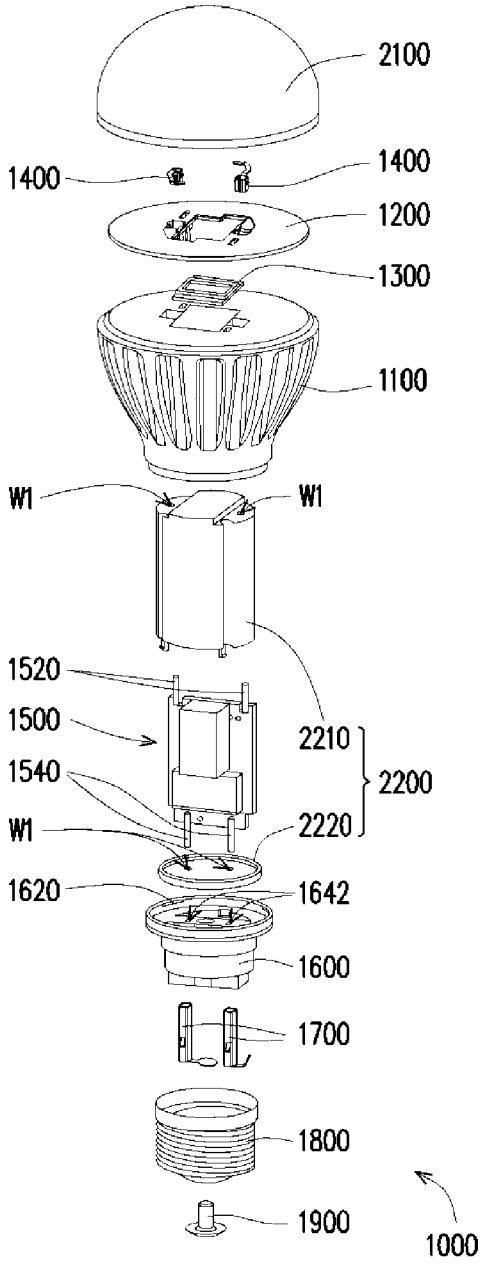
FIG. 1B is an exploded view of the LED bulb of FIG. 1A.

FIG. 1A illustrates a perspective view of an LED bulb in accordance with an embodiment of the present disclosure. FIG. 1B illustrates an exploded view of the LED bulb of FIG. 1A. Referring to FIGS. 1A and 1B, in one embodiment an LED bulb 1000 comprises a heat sink 1100, an insulator cover 1200, a light emitting device package 1300, a plurality of first conductive terminals 1400, a driving circuit 1500, a holder 1600, a plurality of second conductive terminals 1700, a metal screw thread 1800, and an electrode 1900. In the LED bulb 1000, the insulator cover 1200 may be affixed to the heat sink 1100 by a hooking configuration. Accordingly, the light emitting device package 1300, which is disposed between the insulator cover 1200 and the heat sink 1100, can be affixed thereto at the same time. That is, hooks may be utilized for assembly to the heat sink 1100. This design reduces the time and cost of assembly compared to the case of assembly using screws, in addition to enhancing the electrical insulation thereof. Moreover, the first conductive terminals 1400 and the second conductive terminals 1700 may be respectively affixed to insulator cover 1200 and the holder 1600. This design reduces not only the noise associated with traditional connection by wires but also the time it takes to render electrical connection (e.g., wiring) as well as the light being covered by connection terminals.

The following description pertains to the structure and benefits of an embodiment of the LED bulb 1000.

Figure 2A:
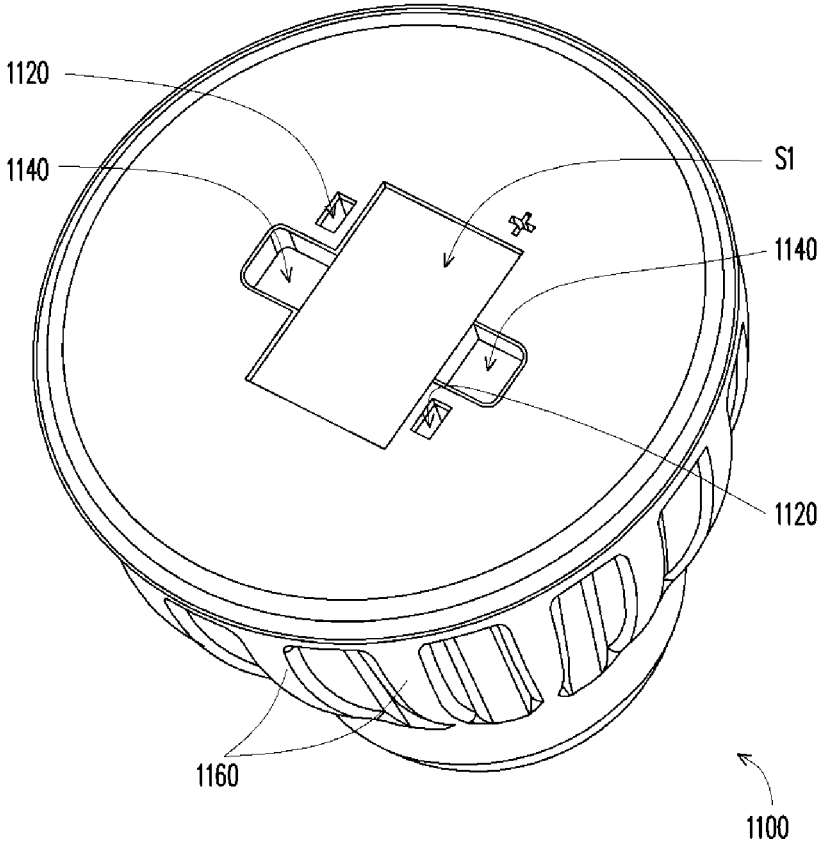
FIG. 2A is a top perspective view of a heat sink as shown in FIG. 1B.
Figure 2B:
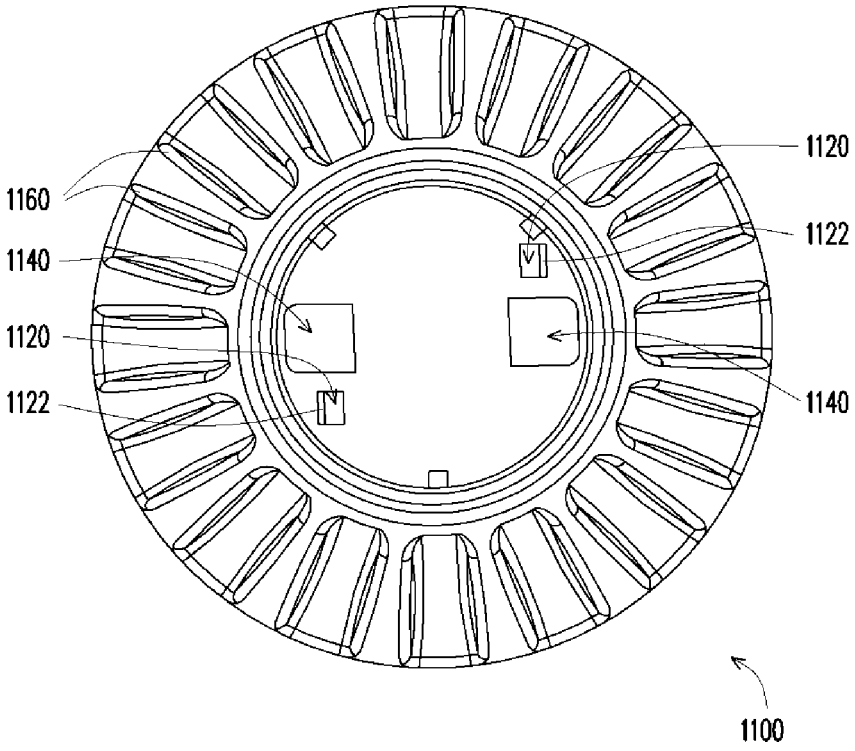
FIG. 2B is a bottom plane view of the heat sink of FIG. 2A.

FIG. 2A illustrates a top perspective view of the heat sink as shown in FIG. 1B. FIG. 2B illustrates a bottom plane view of the heat sink of FIG. 2A. Referring to FIGS. 1A, 1B, 2A and 2B, the heat sink 1100 comprises a component receiving surface S1, a plurality of fastening through holes 1120 and a plurality of positioning through holes 1140. The fastening through holes 1120 and the positioning through holes 1140 are disposed on the component receiving surface S1. In the heat sink 1100, each of at least some of the fastening through holes 1120 comprises a respective fastening protrusion 1122 therein. In one embodiment, the component receiving surface S1 may be a recess of the heat sink 1100 that receives and positions the light emitting device package 1300, to be described below. As shown in FIG. 2A, in some other embodiments, the component receiving surface S1 is not a recess of the heat sink 1100, depending on the need of the user. That is, the component receiving surface S1 may be a recess of the heat sink 1100 when the light emitting device package 1300 needs to be positioned therein. In one embodiment, the heat sink 1100 may include a plurality of heat dissipation fins 1160 that are disposed around a periphery of the heat sink 1100 to promote dissipation of the heat generated by the light emitting device package 1300 from the LED bulb 1000 to the exterior.

Figure 3A:
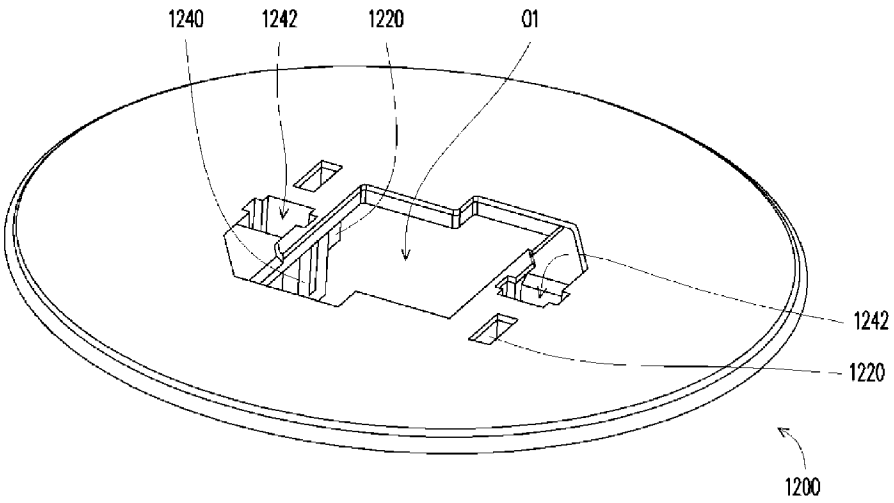
FIG. 3A is a top perspective view of an insulator cover as shown in FIG. 1B.
Figure 3B:
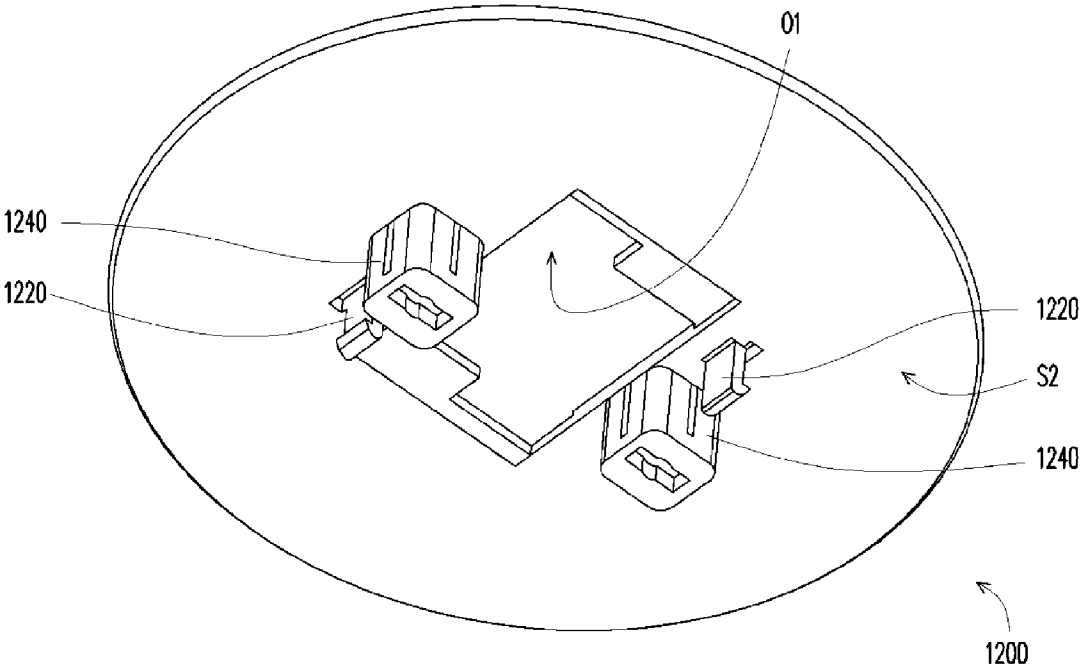
FIG. 3B is a bottom perspective view of the insulator cover as shown in FIG. 1B.

FIG. 3A illustrates a top perspective view of the insulator cover as shown in FIG. 1B. FIG. 3B illustrates a bottom perspective view of the insulator cover as shown in FIG. 1B. Referring to FIGS. 1A, 1B, 3A and 3B, the insulator cover 1200 may be disposed on the heat sink 1100 and may include an opening O1. In one embodiment, the insulator cover 1200 comprises a plurality of hooking parts 1220 and a plurality of terminal receptacles 1240. The hooking parts 1220 and the terminal receptacles 1240 protrude from a surface S2 of the insulator cover 1200, as shown in FIGS. 3A and 3B. Additionally, each of at least some of the terminal receptacles 1240 comprises a respective terminal receptacle through hole 1242 that receives a respective first conductive terminal to be described below.

Figure 4A:
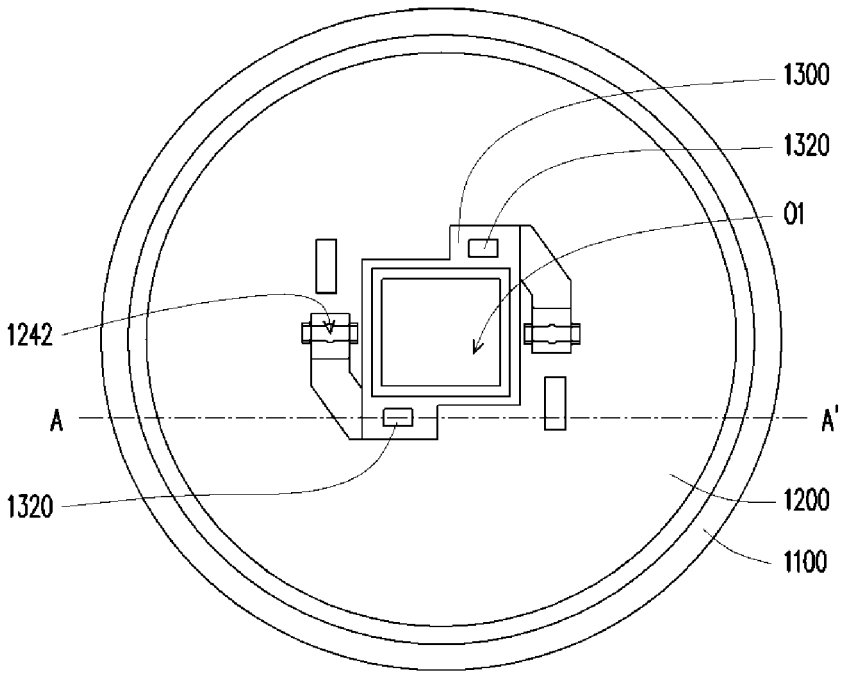
FIG. 4A is a top view of an assembly of an insulator cover, a light emitting device package and a heat sink in accordance with an embodiment of the present disclosure.
Figure 4B:
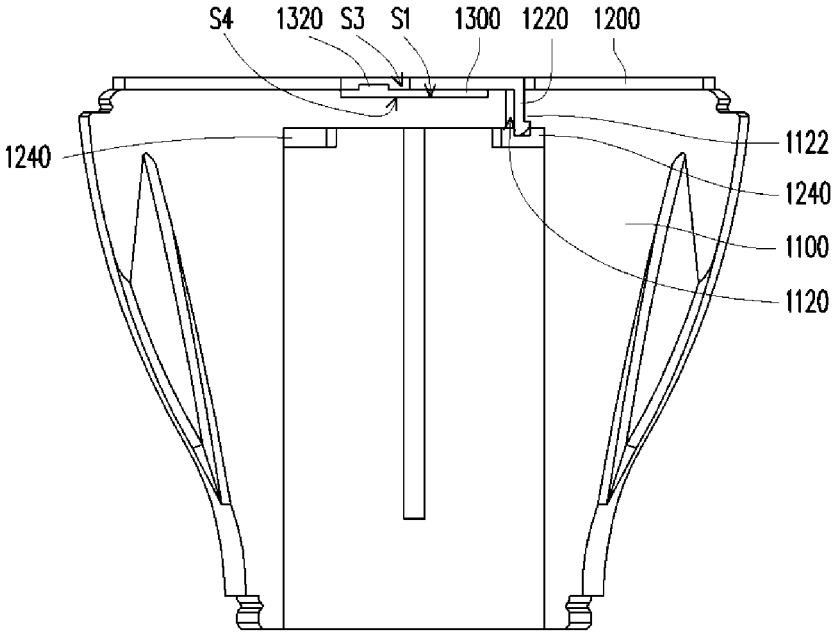
FIG. 4B is a cross-sectional view along the line AA' of FIG. 4A.

FIG. 4A illustrates a top view of an assembly of the insulator cover, the light emitting device package and the heat sink as shown in FIG. 1B. FIG. 4B illustrates a cross-sectional view along the line AA' of FIG. 4A. Referring to FIGS. 1B, 2A, 2B, 3A, 3B, 4A and 4B, as the hooking parts 1220 of the insulator cover 1200 are configured to respectively fasten the fastening through holes 1120 of the heat sink 1100 and as the terminal receptacles 1240 of the insulator cover 1200 are configured to respectively fasten the positioning through holes 1140 of the heat sink 1100, the insulator cover 1200 and the heat sink 1100 are affixed together accordingly. In one embodiment, as each of at least some of the fastening through holes 1120 comprises a respective fastening protrusion 1122 therein, the hooking parts 1220 of the insulator cover 1200 extend into the fastening through holes 1120 to be fastened by the fastening protrusions 1122 in the fastening through holes 1120 when the insulator cover 1200 is disposed in the heat sink 1100. In other words, the insulator cover 1200 and the heat sink 1100 are affixed together by hooks. As shown in FIG. 4B, in one embodiment, the fastening protrusions 1220 of the insulator cover 1200 may be elastic. Accordingly, the hooking parts 1220 of the insulator cover 1200 may relatively easily pass through the fastening protrusions 1122 of the fastening through holes 1120 to be fastened by the fastening protrusions 1122.

In addition, the light emitting device package 1300 is disposed on the component receiving surface S1 and between the insulator cover 1200 and the heat sink 1100. As shown in FIGS. 4A and 4B, as the insulator cover 1200 and the heat sink 1100 may be affixed together by way of hooking, the light emitting device package 1300, disposed between the insulator cover 1200 and the heat sink 1100, may be affixed thereto. The opening O1 of the insulator cover 1200 at least partially exposes the light emitting device package 1300. In one embodiment, the light emitting device package 1300 comprises a plurality of driving electrodes 1320 that are exposed by the opening O1 of the insulator cover 1200, as shown in FIGS. 4A and 4B. More specifically, the light emitting device package 1300 comprises a first surface S3 and a second surface S4 opposite to the first surface S3. The second surface S4 is connected to the component receiving surface S1 and physically contacts the heat sink 1100. The driving electrodes 1320 are disposed on the first surface S3, as shown in FIG. 4B. In one embodiment, the light emitting device package 1300 may include a single LED chip therein. In some other embodiments, the light emitting device package 1300 may include a plurality of LED chips therein.

Figure 5A:
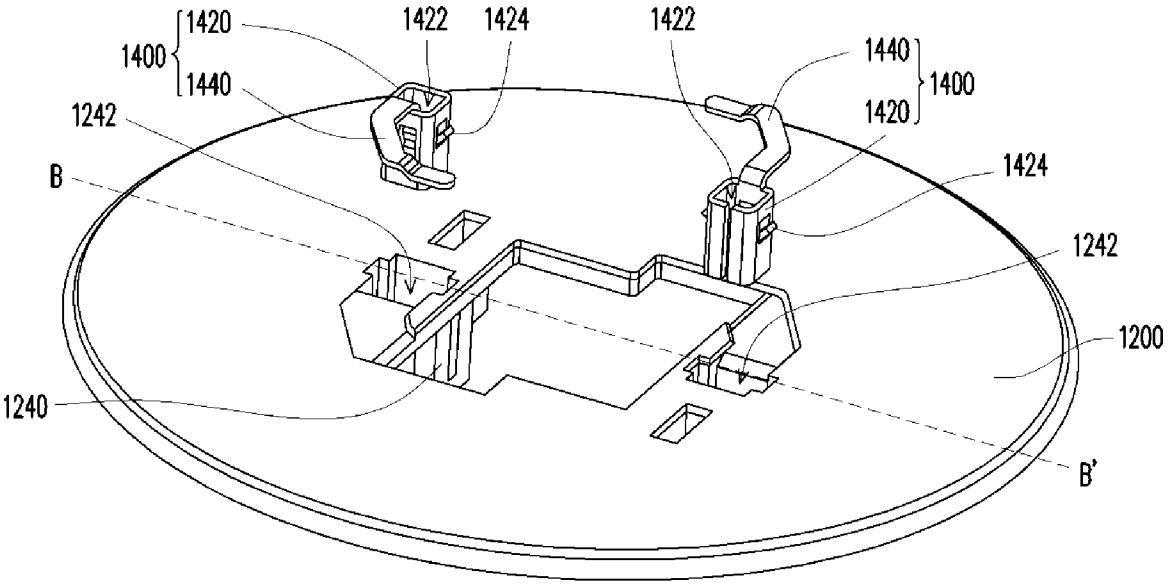
FIG. 5A is a top view of a first conductive terminal and the insulator cover as shown in FIG. 1B when unassembled.
Figure 5B:
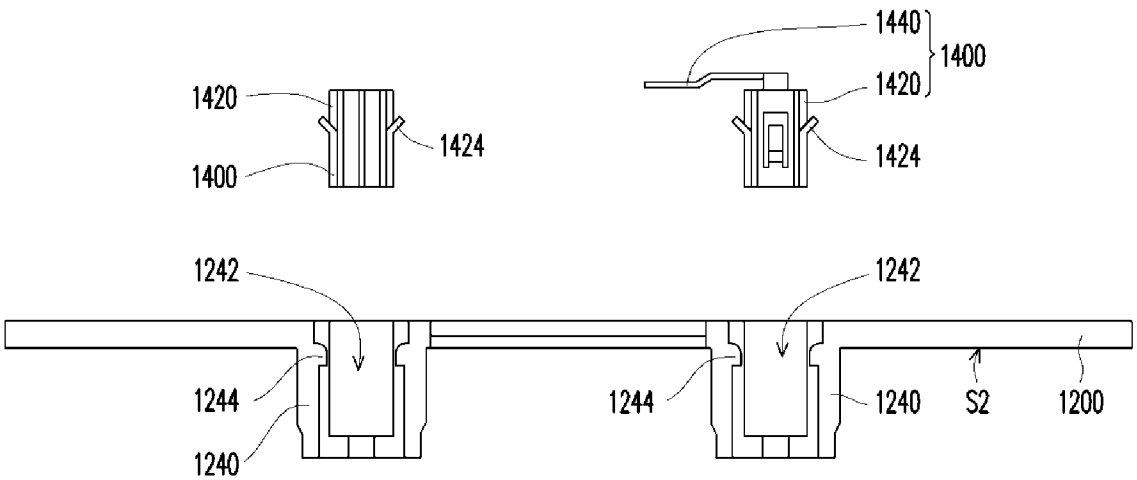
FIG. 5B is a cross-sectional view along the line BB's of FIG. 5A.
Figure 5C:
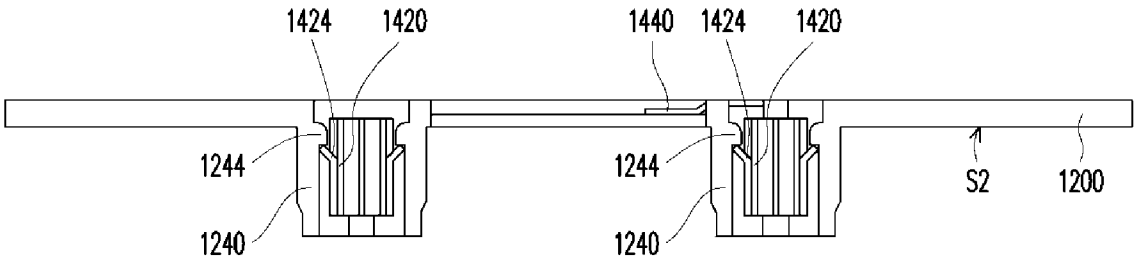
FIG. 5C is a cross-sectional view of the first conductive terminal and the insulator cover of FIG. 5B when assembled.

FIG. 5A illustrates a top view of an assembly of the first conductive terminals and the insulator cover as shown in FIG. 1B. FIG. 5B illustrates a cross-sectional view along the line BB' of FIG. 5A. FIG. 5C illustrates a cross-sectional view of the first conductive terminals and the insulator cover of FIG. 5B when assembled. Referring to FIGS. 1B and 5A-5C, the first conductive terminals 1400 may be respectively disposed in the terminal receptacle through holes 1242 of the insulator cover 1300 and extend outwardly to physically contact the driving electrodes 1320 of the light emitting device package 1300. In one embodiment, each of at least some of the first conductive terminals 1400 respectively comprises a terminal body 1420 and an extension electrode 1440. Each terminal body 1420 comprises a terminal through hole 1422 and a plurality of hooking parts 1424 in the respective terminal through hole 1422. The hooking parts 1424 protrude in a direction away from the respective terminal through hole 1422.

Furthermore, the extension electrodes 1440 of the first conductive terminals 1400 respectively extend outwardly and physically contact the driving electrodes 1320 of the light emitting device package 1300, which is disposed on the heat sink 1100. In one embodiment, in the insulator cover 1200, a sidewall of the terminal receptacle through hole 1242 of each of at least some of the terminal receptacles 1240 respectively comprises a protrusion 1244. When the first conductive terminals 1400 are respectively disposed in the terminal receptacle through holes 1242 of the terminal receptacles 1240, the hooking parts 1424 of the terminal bodies 1420 and the protrusions 1244 of the terminal receptacles 1240 are engaged or otherwise fastened together, as shown in FIG. 5C. In other words, the terminal bodies 1420 can be affixed to the insulator cover 1200 using a hooking method. More specifically, the hooking parts 1424 of the first conductive terminals 1400 may be elastic. Accordingly, the hooking parts 1424 of the first conductive terminals 1400 can easily pass through the protrusions 1244 of the terminal receptacle through holes 1242 to be engaged or otherwise fastened with the protrusions 1244.

Figure 6A:
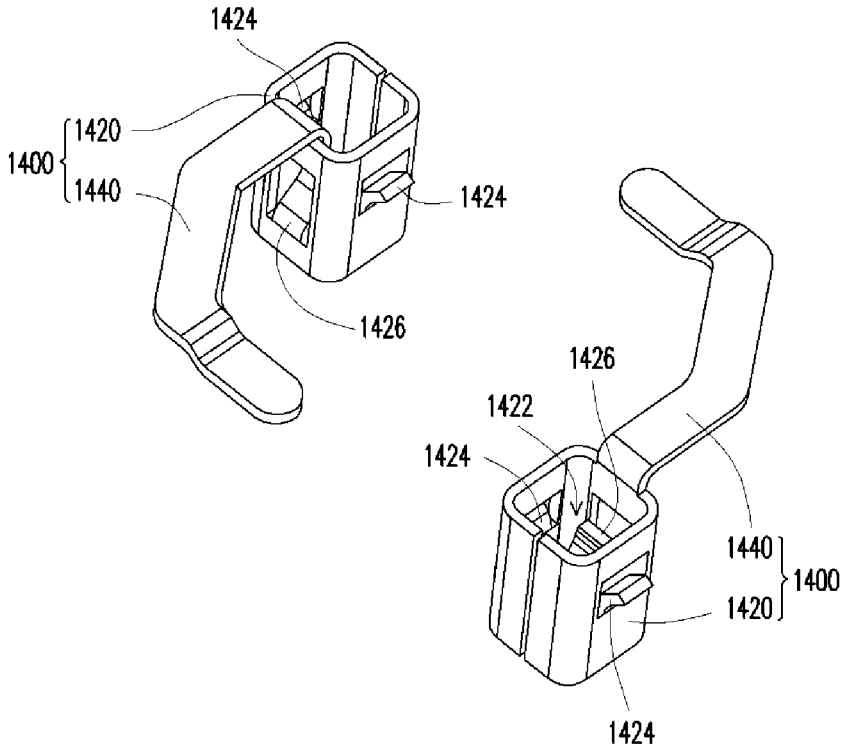
FIG. 6A is a top perspective view of the first conductive terminal as shown in FIG. 1B.
Figure 6B:
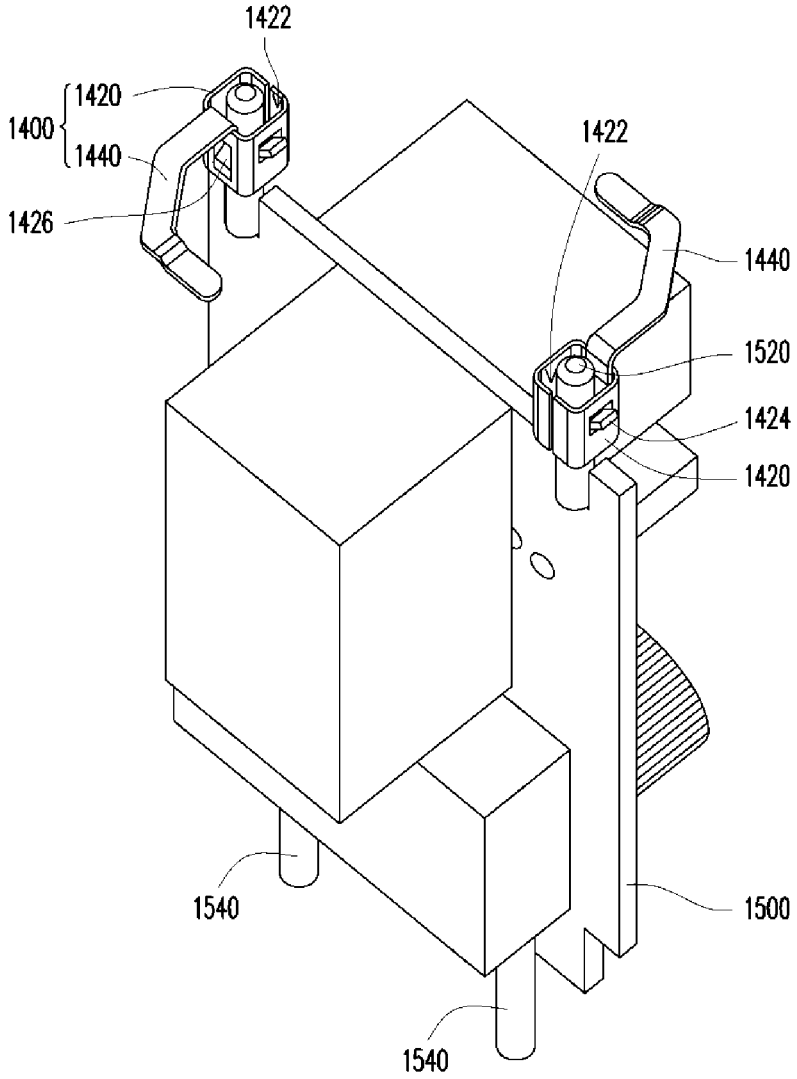
FIG. 6B is a cross-sectional view of the first conductive terminal and the driving circuit as shown in FIG. 1B when assembled.

FIG. 6A illustrates a top perspective view of the first conductive terminals as shown in FIG. 1B. FIG. 6B illustrates a cross-sectional view of the first conductive terminals and the driving circuit as shown in FIG. 1B when assembled. Referring to FIGS. 1B, 6A and 6B, the driving circuit 1500 is configured to convert a power signal of an external power source to a power signal applicable to the light emitting device package 1300. For example, the driving circuit 1500 may be configured to convert an alternating current (AC) signal from an external power source to a direct current (DC) signal to drive the light emitting device package 1300. In one embodiment, the driving circuit 1500 may include a plurality of upper conductive rods 1520 and a plurality of lower conductive rods 1540. The upper conductive rods 1520 may be respectively in physical contact with the first conductive terminals 1400, as shown in FIG. 6B. In one embodiment, each of at least some of the terminal bodies 1420 of the first conductive terminals 1400 respectively comprises a terminal bending part 1426 that is bent toward the respective terminal through hole 1422, as shown in FIG. 6A. Accordingly, when the upper conductive rods 1520 of the driving circuit 1500 are disposed in the terminal through holes 1422 of the first conductive terminals 1400, the first conductive terminals 1400 can be in physical contact and electrical connection with at least some of the upper conductive rods 1520 through the terminal bending parts 1426. In some other embodiments, the first conductive terminals 1400 are configured without the terminal bending parts 1426, and a size of the terminal through holes 1422 is designed to be equal to or substantially equal to a size of the upper conductive rods 1520 such that the upper conductive rods 1520 are in physical contact with the terminal bodies 1420 when disposed in the terminal through holes 1422.

Figure 7A:
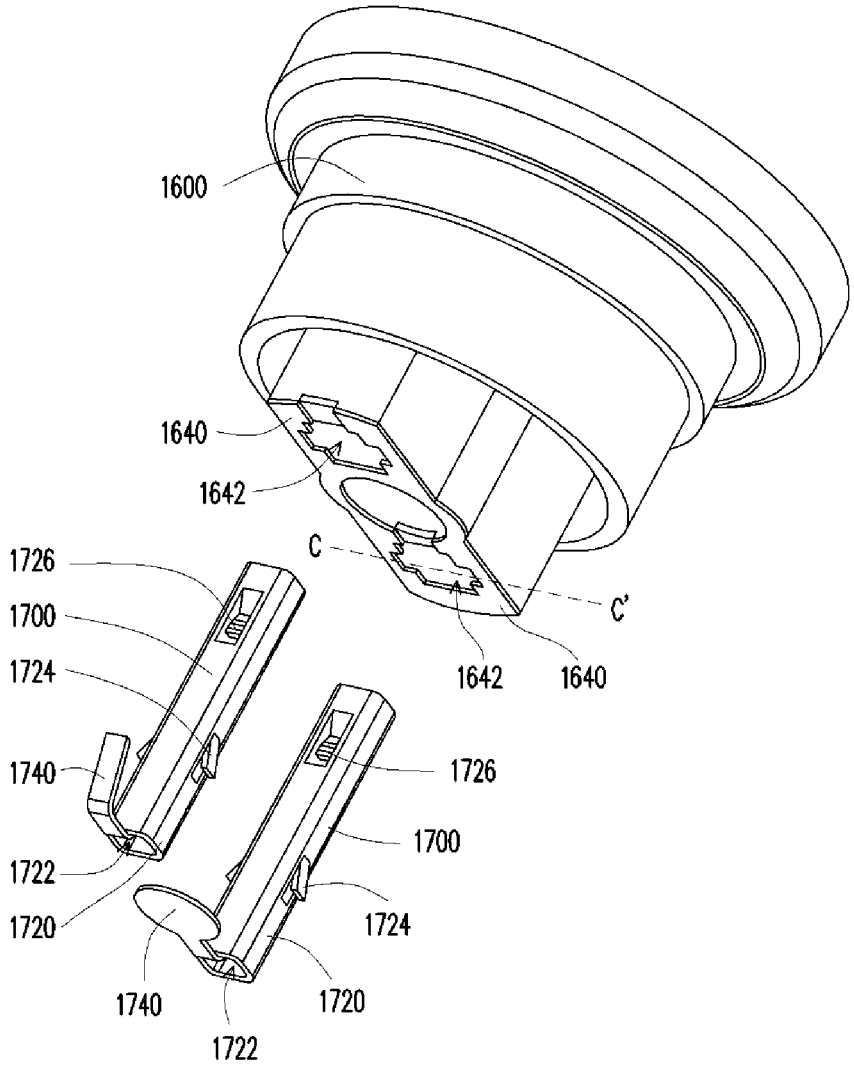
FIG. 7A is a perspective view of a holder and two second conductive terminals as shown in FIG. 1B when unassembled.
Figure 7B:
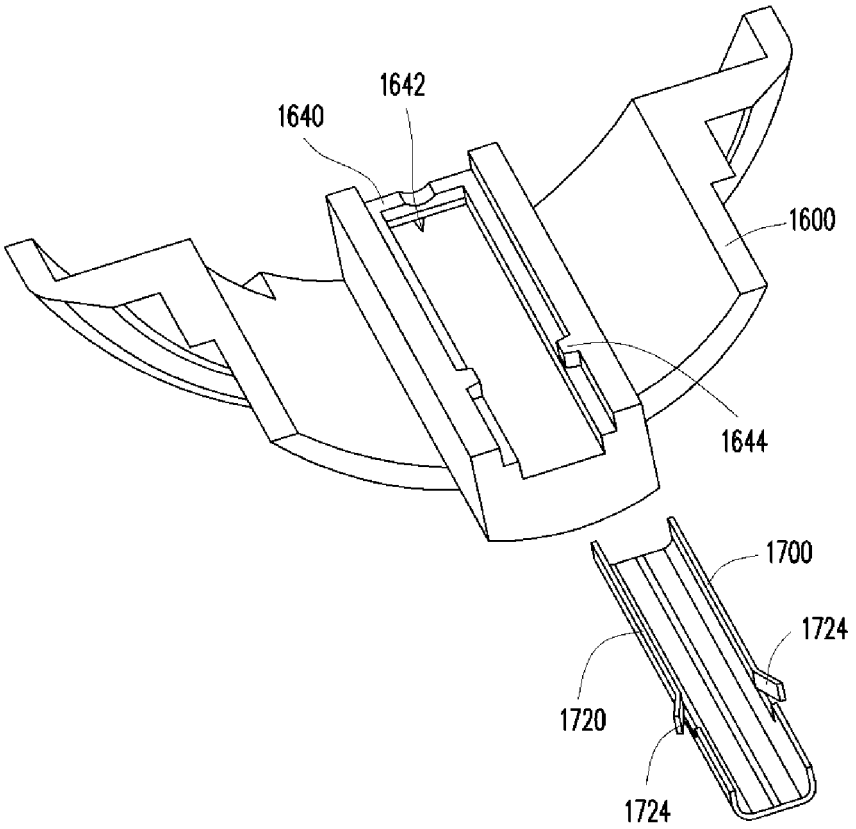
FIG. 7B is a cross-sectional view along the line CC' of FIG. 7A.
Figure 8A:
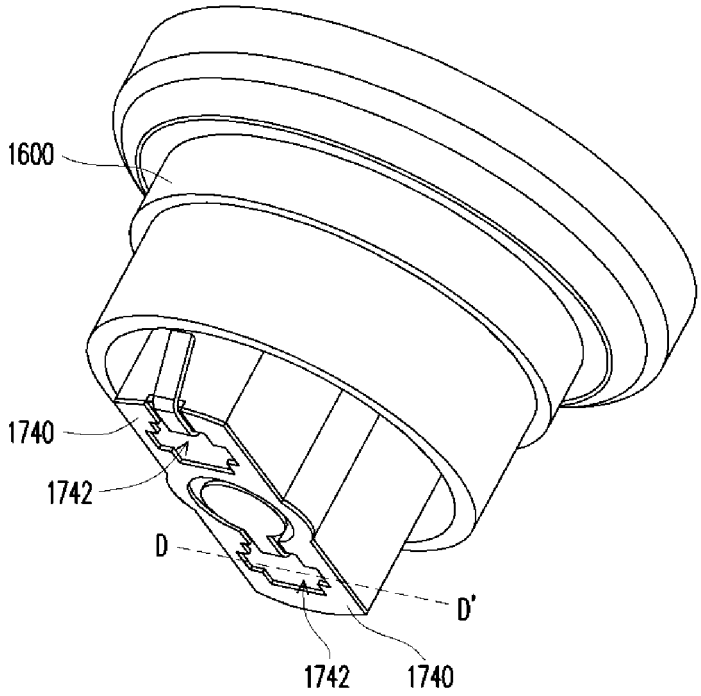
FIG. 8A is a perspective view of the holder and the two conductive terminals of FIG. 7A when assembled.
Figure 8B:
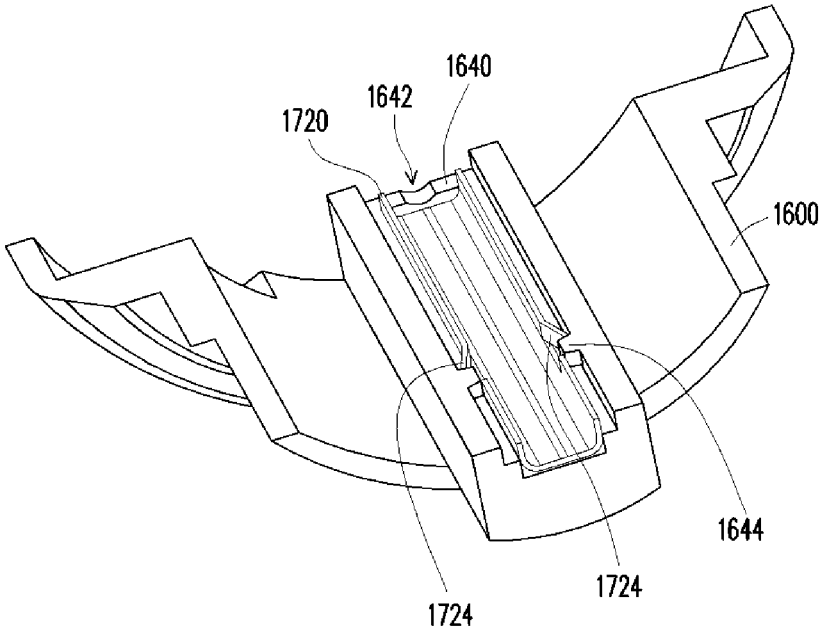
FIG. 8B is a cross-sectional view along the line DD' of FIG. 8A.

FIG. 7A illustrates a perspective view of the holder and a plurality of second conductive terminals as shown in FIG. 1B when unassembled. FIG. 7B illustrates a cross-sectional view along the line CC' of FIG. 7A. FIG. 8A illustrates a perspective view of the holder and the plurality of second conductive terminals as shown in FIG. 7A when assembled. FIG. 8B illustrates a cross-sectional view along the line DD' of FIG. 8A. Referring to FIGS. 1B, 7A-7B and 8A-8B, the holder 1600 comprises a holding protrusion 1620 and a plurality of terminal receptacles 1640. The holder 1600 is configured to be assembled to the heat sink 1100 via the holding protrusion 1620. Each of at least some of the terminal receptacles 1640 comprises a respective terminal receptacle through hole 1642. The second conductive terminals 1700 are respectively disposed in the terminal receptacle through holes 1642 of the terminal receptacles 1640. Accordingly, when the lower conductive rods 1540 of the driving circuit 1500 are disposed in the terminal receptacle through holes 1642 of the holder 1600, the second conductive terminals 1700 are respectively in physical contact with the lower conductive rods 1540 of the driving circuit 1500.

In one embodiment, each of at least some of the second conductive terminals 1700 respectively comprises a terminal body 1720 and an extension electrode 1740. Each terminal body 1720 comprises a terminal through hole 1722 and a plurality of terminal hooking parts 1724 in the respective terminal through hole 1722. The terminal hooking parts 1724 protrude in a direction away from the respective terminal through hole 1722, as shown in FIG. 7A. Additionally, the extension electrodes 1740 of the second conductive terminals 1700 respectively extend and physically contact the metal screw thread 1800 and the electrode 1900. In one embodiment, a sidewall of the terminal receptacle through hole 1642 of each of at least some of the terminal receptacles 1640 respectively comprises a protrusion 1644. When each of the second conductive terminals 1700 is respectively disposed in the terminal receptacle through holes 1642 of a respective terminal receptacle 1640, the terminal hooking part 1724 of the respective terminal body 1720 and the protrusion 1644 of the respective terminal receptacle 1640 are engaged or otherwise fastened together, as shown in FIG. 8B. In other words, the terminal bodies 1720 can be affixed to the holder 1600 using a hooking method. More specifically, the hooking parts 1724 of the second conductive terminals 1700 may be elastic. Accordingly, the hooking parts 1724 of the second conductive terminals 1700 can easily pass through the protrusions 1644 of the terminal receptacle through holes 1642 to be engaged or otherwise fastened with the protrusions 1644, as shown in FIG. 8B.

Similarly, each of at least some of the terminal bodies 1720 of the second conductive terminals 1700 respectively comprises a terminal bending part 1426 that is bent toward the respective terminal through hole 1722, as shown in FIG. 7A. Accordingly, when the lower conductive rods 1540 of the driving circuit 1500 are disposed in the terminal through holes 1722 of the second conductive terminals 1700, the second conductive terminals 1700 can be in physical contact and electrically connected with at least some of the lower conductive rods 1540 through the terminal bending parts 1726. In some other embodiments, the second conductive terminals 1700 are configured without the terminal bending parts 1726, and a size of the terminal through holes 1722 is designed to be equal to or substantially equal to a size of the lower conductive rods 1540 such that the lower conductive rods 1540 are in physical contact with the terminal bodies 1720 when disposed in the terminal through holes 1722.

Figure 9A:
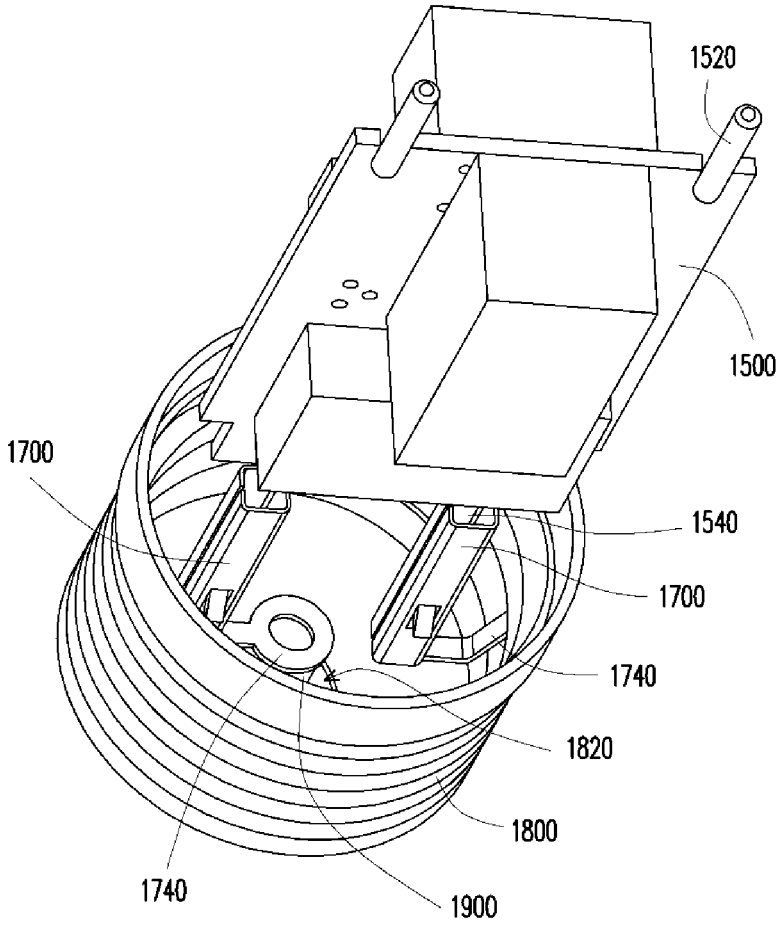
FIG. 9A is a perspective view of an assembly of the driving circuit, second conductive terminals, a metal screw thread and a electrode as shown in FIG. 1B.
Figure 9B:
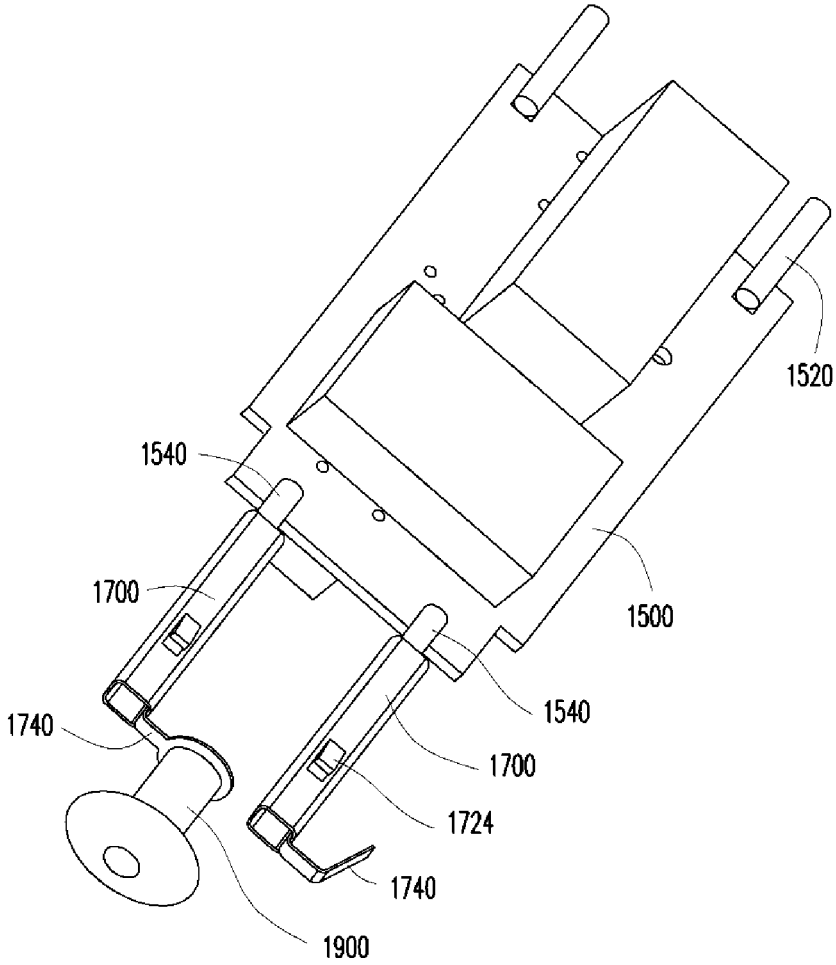
FIG. 9B is a perspective view of the driving circuit, the second conductive terminals and the electrode as shown in FIG. 1B when assembled.

FIG. 9A illustrates a perspective view of the driving circuit, the second conductive terminals, the metal screw thread and the electrode as shown in FIG. 1B when assembled. FIG. 9B illustrates a perspective view of the driving circuit, the second conductive terminals and the electrode as shown in FIG. 1B when assembled. Referring to FIGS. 1B, 9A and 9B, the metal screw thread 1800 is connected to the holder 1600 and comprises a screw thread through hole 1820. The electrode 1900 is disposed in the screw thread through hole 1820 of the metal screw thread 1800. In one embodiment, as the extension electrodes 1740 of the second conductive terminals 1700 respectively extend and physically contact the metal screw thread 1800 and the electrode 1900, the metal screw thread 1800 and the electrode 1900 are electrically connected to the lower conductive rods 1540, respectively. For example, the metal screw thread 1800 may be electrically connected to a first one of the lower conductive rods 1540 while the electrode 1900 may be electrically connected to a second one of the lower conductive rods 1540.

It can be seen from the above description that components of an LED bulb 1000 according to the present disclosure may be assembled together using hooks, engagement or other fastening methods. Accordingly, as there is no need of screws for assembly, potential hazards to a user when disassembling the LED bulb 1000 may be avoided. Additionally, by utilizing the first conductive terminals 1400 and the second conductive terminals 1700 in the design of the LED bulb 1000 according to the present disclosure, inconvenience associated with using screws for assembly can be minimized as components can be hooked or otherwise engaged or fastened to the insulator cover 1200 and the holder 1600. Moreover, noise signals traditionally associated with the usage of wiring to connect the terminals, the time it takes to connect the wiring and light blocking effect due to wiring can be reduced. Furthermore, as the insulator cover 1200 of the LED bulb 1000 in an embodiment is affixed to the heat sink 1100 using a hooking method, the light emitting device package 1300, which is disposed between the insulator cover 1200 and the heat sink 1100, can also be affixed thereto at the same time. That is, hooks may be utilized for assembly to the heat sink 1100. This design reduces the time and cost of assembly compared to the case of assembly using screws, in addition to enhancing the electrical insulation thereof.

In one embodiment, the above-described LED bulb 1000 further comprises a lens 2100. The lens 2100 is disposed on the heat sink 1100 and physically in physical contact with or coupled to the heat sink 1100. The lens 2100 may at least partially or totally cover the light emitting device package 1300 and the insulator cover 1200, as shown in FIGS. 1A and 1B. Additionally, the LED bulb 1000 may further comprise an insulation box 2200. The insulation box 2200 contains the driving circuit 1500 therein and is itself disposed in the heat sink 1100 to avoid interference of the driving circuit 1500 by electric charge from the external environment. In one embodiment, the insulation box 2200 comprises an upper box part 2210 and a lower box part 2220. The insulation box 2200 comprises at least four holes W1. The upper conductive rods 1520 and the lower conductive rods 1540 may traverse through the holes W1 to be exposed outside of the insulation box 2200 and electrically connected with the first conductive terminals 1400 and the second conductive terminals 1700, respectively.

In summary, an LED bulb in accordance with the present disclosure offers at least a number of advantages. Firstly, the insulator cover and the heat sink are affixed together via hooking. Consequently, the light emitting device package, which is disposed between the insulator cover and the heat sink can be affixed thereto at the same time. That is, assembly to the heat sink using hooks not only can minimize the cost and time associated with assembling using screws but also can enhance the electrical insulation thereof. Secondly, the first conductive terminals and the second conductive terminals may be respectively affixed to the insulator cover and the holder via engagement or other fastening method such as hooking. This design minimizes inconvenience associated with using screws for assembly as components can be hooked or otherwise engaged or fastened to the insulator cover 1200 and the holder 1600. Moreover, noise signals traditionally associated with the usage of wiring to connect the terminals, the time it takes to connect the wiring and light blocking effect due to wiring can be reduced. Moreover, as components of the LED bulb can be assembled together using hooks, engagement or other fastening methods, there is no need of screws for assembly, potential hazards to a user when disassembling the LED bulb 1000 may be avoided.

A number of embodiments of the present invention are described herein. However, as those skilled in the art would appreciate, the scope of the present invention is not and cannot be limited to the disclosed embodiments. More specifically, one ordinarily skilled in the art may make various deviations and improvements based on the disclosed embodiments, and such deviations and improvements are still within the scope of the present invention. Accordingly, the scope of protection of a patent issued from the present disclosure is determined by the claims as follows.

What is claimed is:

1. A light emitting diode (LED) bulb, comprising:

a heat sink comprising a component receiving surface, a plurality of fastening through holes, and a plurality of positioning through holes, the fastening through holes and the positioning through holes disposed on the component receiving surface;

an insulator cover disposed on the heat sink and having an opening, the insulator cover comprising a plurality of hooking parts and a plurality of terminal receptacles, the hooking parts and the terminal receptacles protruding from a surface of the insulator cover, each of at least some of the hooking parts configured to be engaged with a respective one of the fastening through holes and each of at least some of the terminal receptacles configured to pass through a respective one of the positioning through holes to be engaged with the respective positioning through hole such that the insulator cover is affixed to the heat sink, each of at least some of the terminal receptacles respectively having a terminal receptacle through hole;

a light emitting device package disposed on the component receiving surface of the heat sink and having a plurality of driving electrodes, the light emitting device package disposed between the insulator cover and the heat sink, the light emitting device package affixed to the insulator cover with the opening of the insulator cover exposing a portion of the light emitting device package;

a plurality of conductive terminals respectively disposed in the terminal receptacle through holes of the terminal receptacles, the conductive terminals extending outwardly and in physical contact with the driving electrodes of the light emitting device package;

a driving circuit that outputs a current signal to drive the light emitting device package, the driving circuit comprising a plurality of upper conductive rods and a plurality of lower conductive rods, the upper conductive rods in physical contact with the conductive terminals;

a holder comprising a holding protrusion, the holder configured to be assembled to the heat sink via the holding protrusion;

a screw thread coupled to the holder and comprising a screw thread through hole, the screw thread electrically connected to a first one of the lower conductive rods; and an electrode disposed in the screw thread through hole and electrically connected to a second one of the lower conductive rods.

2. The LED bulb as recited in claim 1, further comprising a lens disposed on and coupled to the heat sink, the lens at least partially or totally covering the light emitting device package and the insulator cover.

3. The LED bulb as recited in claim 1, further comprising an insulation box disposed in the heat sink and containing the driving circuit therein, the insulation box comprising a plurality of holes, the upper conductive rods and the lower conductive rods traversing through the holes to be exposed outside of the insulation box.

4. The LED bulb as recited in claim 1, wherein each of at least some of the conductive terminals respectively comprises a terminal body and an extension electrode, the terminal body comprising a terminal through hole and a plurality of hooking parts in the terminal through hole, the hooking parts protruding in a direction away from the respective terminal through hole.

5. The LED bulb as recited in claim 4, wherein the extension electrodes of the conductive terminals extend outwardly and physically contact the driving electrodes of the light emitting device package.

6. The LED bulb as recited in claim 4, wherein a sidewall of the terminal receptacle through hole of each of at least some of the terminal receptacles respectively comprises a protrusion, and wherein the hooking parts of the terminal bodies and the protrusions of the terminal receptacles are engaged together.

7. The LED bulb as recited in claim 4, wherein each of at least some of the conductive terminals comprises a terminal bending part in the respective terminal through hole that is electrically connected with at least some of the upper conductive rods.

8. The LED bulb as recited in claim 1, wherein the light emitting device package comprises a first surface and a second surface opposite to the first surface, the second surface connected to the component receiving surface and in physical contact with the heat sink, and wherein the driving electrodes are disposed on the first surface.

9. The LED bulb as recited in claim 1, wherein the heat sink comprises a plurality of heat dissipation fins disposed around the heat sink.

10. A light emitting diode (LED) bulb, comprising:

a heat sink having a component receiving surface;

a light emitting device package disposed on the component receiving surface and comprising a plurality of driving electrodes;

a driving circuit that outputs a current signal to drive the light emitting device package, the driving circuit comprising a plurality of upper conductive rods and a plurality of lower conductive rods, the upper conductive rods electrically connected with the driving electrodes;

a holder comprising a holding protrusion and a plurality of terminal receptacles, each of at least some of the terminal receptacles comprising a respective terminal receptacle through hole, at least some of the lower conductive rods disposed in the terminal receptacle through holes;

a plurality of conductive terminals respectively disposed in the terminal receptacle through holes of the terminal receptacles and in physical contact with the lower conductive rods;

a screw thread coupled to the holder and having a screw thread through hole; and an electrode disposed in the screw thread through hole of the screw thread, the conductive terminals extending outwardly and in physical contact with the screw thread and the electrode such that each of the screw thread and the electrode is electrically connected with a respective one of the lower conductive rods.

11. The LED bulb as recited in claim 10, further comprising a lens disposed on and coupled to the heat sink, the lens at least partially or totally covering the light emitting device package.

12. The LED bulb as recited in claim 10, further comprising an insulation box disposed in the heat sink and containing the driving circuit therein, the insulation box comprising a plurality of holes, the upper conductive rods and the lower conductive rods traversing through the holes to be exposed outside of the insulation box.

13. The LED bulb as recited in claim 10, wherein each of at least some of the conductive terminals respectively comprises a terminal body and an extension electrode, the terminal body comprising a terminal through hole and a plurality of hooking parts in the terminal through hole, the hooking parts protruding in a direction away from the respective terminal through hole.

14. The LED bulb as recited in claim 13, wherein the extension electrodes of the conductive terminals extend outwardly and physically contact the screw thread and the electrode.

15. The LED bulb as recited in claim 13, wherein a sidewall of the terminal receptacle through hole of each of at least some of the terminal receptacles respectively comprises a protrusion, and wherein the hooking parts of the terminal bodies and the protrusions of the terminal receptacles are engaged together.

16. The LED bulb as recited in claim 13, wherein each of at least some of the conductive terminals comprises a terminal bending part in the respective terminal through hole that is bent toward the respective terminal through hole and electrically connected with at least some of the lower conductive rods.

17. The LED bulb as recited in claim 10, wherein the light emitting device package comprises a first surface and a second surface opposite to the first surface, the second surface connected to the component receiving surface and in physical contact with the heat sink, and wherein the driving electrodes are disposed on the first surface.

18. The LED bulb as recited in claim 10, wherein the heat sink comprises a plurality of heat dissipation fins disposed around the heat sink.

19. A light emitting diode (LED) bulb, comprising:

a heat sink comprising a component receiving surface, a plurality of fastening through holes, and a plurality of positioning through holes, the fastening through holes and the positioning through holes disposed on the component receiving surface;

an insulator cover disposed on the heat sink and having an opening, the insulator cover comprising a plurality of first hooking parts and a plurality of first terminal receptacles, the first hooking parts and the first terminal receptacles protruding from a surface of the insulator cover, each of at least some of the first hooking parts configured to be engaged with a respective one of the fastening through holes and each of at least some of the first terminal receptacles configured to pass through a respective one of the positioning through holes to be engaged with the respective positioning through hole such that the insulator cover is affixed to the heat sink, each of at least some of the first terminal receptacles respectively having a first terminal receptacle through hole;

a light emitting device package disposed on the component receiving surface of the heat sink and having a plurality of driving electrodes, the light emitting device package disposed between the insulator cover and the heat sink, the light emitting device package affixed to the insulator cover with the opening of the insulator cover exposing a portion of the light emitting device package;

a plurality of first conductive terminals respectively disposed in the first terminal receptacle through holes of the first terminal receptacles, the first conductive terminals extending outwardly and in physical contact with the driving electrodes of the light emitting device package;

a driving circuit comprising a plurality of upper conductive rods and a plurality of lower conductive rods, the upper conductive rods in physical contact with the first conductive terminals;

a holder comprising a holding protrusion and a plurality of second terminal receptacles, the holder configured to be assembled to the heat sink via the holding protrusion, each of at least some of the second terminal receptacles respectively comprising a second terminal receptacle through hole, the lower conductive rods disposed in the second terminal receptacle through holes;

a plurality of second conductive terminals disposed in the second terminal receptacle through holes of the second terminal receptacles and in physical contact with the lower conductive rods;

a screw thread coupled to the holder and comprising a screw thread through hole, the screw thread electrically connected to a first one of the lower conductive rods; and an electrode disposed in the screw thread through hole and electrically connected to a second one of the lower conductive rods, wherein the second conductive terminals extend outwardly and physically contact the screw thread and the electrode such that the screw thread and the electrode are electrically connected with the first one of the lower conductive rods and the second one of the lower conductive rods, respectively.

20. The LED bulb as recited in claim 19, further comprising a lens disposed on and coupled to the heat sink, the lens at least partially or totally covering the light emitting device package and the insulator cover.

* * * * *